US009009997B1

(12) United States Patent
Kemp

(10) Patent No.: US 9,009,997 B1
(45) Date of Patent: Apr. 21, 2015

(54) DISPLAY FIXTURE

(71) Applicant: Spanx, Inc., Atlanta, GA (US)

(72) Inventor: Robert Kemp, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 0 days.

(21) Appl. No.: 14/196,872

(22) Filed: Mar. 4, 2014

(51) Int. Cl.
*G09F 1/10* (2006.01)
*G09F 7/18* (2006.01)
*A47F 1/12* (2006.01)

(52) U.S. Cl.
CPC .... *G09F 7/18* (2013.01); *A47F 1/12* (2013.01)

(58) Field of Classification Search
CPC ..... A47F 5/0846; G09F 1/10
USPC ..... 40/124; 211/55, 59.2
See application file for complete search history.

(56) References Cited

U.S. PATENT DOCUMENTS 3,908,830 A * 9/1975 Skrzelowski ..... 211/55
4,164,287 A * 8/1979 Muller et al. ..... 211/134
4,488,652 A * 12/1984 Hinton et al. ..... 211/183
4,813,536 A * 3/1989 Willis ..... 206/765
5,105,952 A * 4/1992 Krattiger ..... 211/40
5,593,048 A * 1/1997 Johnson ..... 211/59.2
6,068,135 A * 5/2000 Holztrager ..... 211/4
6,145,671 A * 11/2000 Riga et al. ..... 211/13.1
6,334,540 B1 * 1/2002 Plutsky ..... 211/43
6,427,853 B2 * 8/2002 Brozak, Jr. ..... 211/55
6,427,857 B1 * 8/2002 Adams et al. ..... 211/189
6,497,329 B1 * 12/2002 Johnson et al. ..... 211/128.1
6,607,083 B1 * 8/2003 Webb ..... 211/59.2
6,877,616 B2 * 4/2005 Plutsky ..... 211/43
6,929,133 B1 * 8/2005 Knapp et al. ..... 211/118
7,040,492 B1 * 5/2006 Lemons ..... 211/57.1
7,097,049 B1 * 8/2006 Singer et al. ..... 211/55
7,249,430 B2 * 7/2007 Kerker et al. ..... 40/124
7,703,225 B2 * 4/2010 Kerker et al. ..... 40/124
2001/0025823 A1 * 10/2001 Brozak ..... 211/55
2004/0195192 A1 * 10/2004 Belokin et al. ..... 211/59.1
2005/0173362 A1 * 8/2005 Squitieri et al. ..... 211/187
2006/0131250 A1 * 6/2006 Richardson et al. ..... 211/50
2010/0163501 A1 * 7/2010 Berry et al. ..... 211/55
2010/0326939 A1 * 12/2010 Clark et al. ..... 211/153
2011/0204009 A1 * 8/2011 Karan ..... 211/59.2
2011/0266236 A1 * 11/2011 Clark et al. ..... 211/59.2
2013/0062293 A1 * 3/2013 Beaty ..... 211/59.2
2013/0081311 A1 * 4/2013 Luo et al. ..... 40/584
2014/0075794 A1 * 3/2014 Belk et al. ..... 40/584
2014/0091051 A1 * 4/2014 Battilana ..... 211/119.003
2014/0110361 A1 * 4/2014 Newkirk et al. ..... 211/13.1

* cited by examiner

*Primary Examiner* — Shin Kim
(74) *Attorney, Agent, or Firm* — Meunier Carlin & Curfman, LLC

(57) ABSTRACT

The present disclosure is directed to a display fixture used to convey information to a consumer that is easily coupled to a display rack by inserting portions of the fixture into the product storage spaces of the display rack. The display fixture can include a display panel, a first arm, a second arm, and a third arm where the arms can be sized and configured for placement in the product storages space of an associated display rack.

21 Claims, 7 Drawing Sheets

DISPLAY FIXTURE

TECHNICAL FIELD

This disclosure relates generally to a display rack for displaying merchandise, such as clothing and hosiery. More specifically, this disclosure relates to a display fixture used to convey information to a consumer that is easily coupled to a display rack by inserting portions of the fixture into the product storage spaces of the display rack.

BACKGROUND

In a retail setting, items for purchase, in particular clothing, are often stored and displayed on a display rack. Display racks generally include hanging racks and those with shelves or compartments for receiving the product. Regardless of the type of display rack used, it is desirable to draw the consumer's attention to the display and provide certain information about the product. Retailers may attach some type of permanent or semi-permanent signage to a display rack for conveying product and/or marketing information. For example, a metal or plastic frame-like fixture can be attached to the display rack and a temporary sign is inserted into/on the display window of the fixture to provide information to the consumer. While these display fixtures can be effective at providing information to the consumer, they are cumbersome, limited in size and design, and do not provide the durability one would expect from a more permanent fixture. Accordingly, a need in the art exists for a display fixture that is easily coupled to and removed from the display rack and also provides diversity in both size and style of the display surface.

SUMMARY

Presented are systems and methods for associating a display fixture used to convey information to a consumer with a product display rack. An aspect of the present disclosure is directed to a display fixture. The display fixture may include a display panel, a first arm, a second arm, and a third arm. The display panel may define a display surface for providing information to a consumer. The first arm may extend from a bottom edge of the display panel and be configured for placement in a product storage space of an associated display rack. The second arm may also extend from the bottom edge of the display panel and be configured for placement in a product storage space of an associated display rack. The third arm may extend from the bottom edge of the display panel at a position between the first arm and the second arm. The third arm may include a recess having a recess width corresponding to a width of a divider separating adjacent product storage spaces of an associated display rack. At least one of the first arm, second arm, and third arm may have a width corresponding to a width of a product storage space of an associated display rack.

Another aspect of the present disclosure is directed to a product display rack and associated display fixture. The display rack may include product storage spaces configured to display a product package in a front-facing manner. The product storage spaces may be arranged in rows vertically along a height of the display rack. The display fixture may include a display panel, a first arm, a second arm, and a third arm. The display panel may define a display surface for providing information to a consumer. The first arm may extend from a bottom edge of the display panel and be configured for placement in a first product storage space of the display rack. The second arm may extend from the bottom edge of the display panel and be configured for placement in a second product storage space of the display rack. The third arm may extend from the bottom edge of the display panel at a position between the first arm and the second arm. The third arm may include a recess having a recess width corresponding to a width of a divider separating adjacent product storage spaces of the display rack. At least one of the first arm, second arm, and third arm may have a width corresponding to a width of at least one of the product storage spaces of the display rack. The display fixture may be positioned along a row of product storage spaces such that the first arm is received within a first product storage space and the second arm is received in a second product storage space.

A further aspect of the present disclosure is directed to a method of providing a display fixture to a display rack. The method may include providing a display fixture having a display panel, a first arm, a second arm and a third arm each extending from a bottom edge of the display panel, the third arm located at a position between the first and second arm. The first arm may be received within a first product storage space of the display rack. The second arm may be received within a second product storage space of the display rack. A recess provided in the third arm may be received over a divider separating adjacent product storage spaces of the display rack.

The details of one or more embodiments of the disclosure are set forth in the accompanying drawings and description below. Other features, objects, and advantages of the disclosure will be apparent from the description and drawings, and from the claims.

DESCRIPTION OF DRAWINGS

The device is explained in even greater detail in the following drawings. The drawings are merely examples to illustrate the structure of preferred devices and certain features that may be used singularly or in combination with other features. The disclosure should not be limited to the examples shown.

Like reference symbols in the various drawings indicate like elements.

DETAILED DESCRIPTION

Figure 1A:
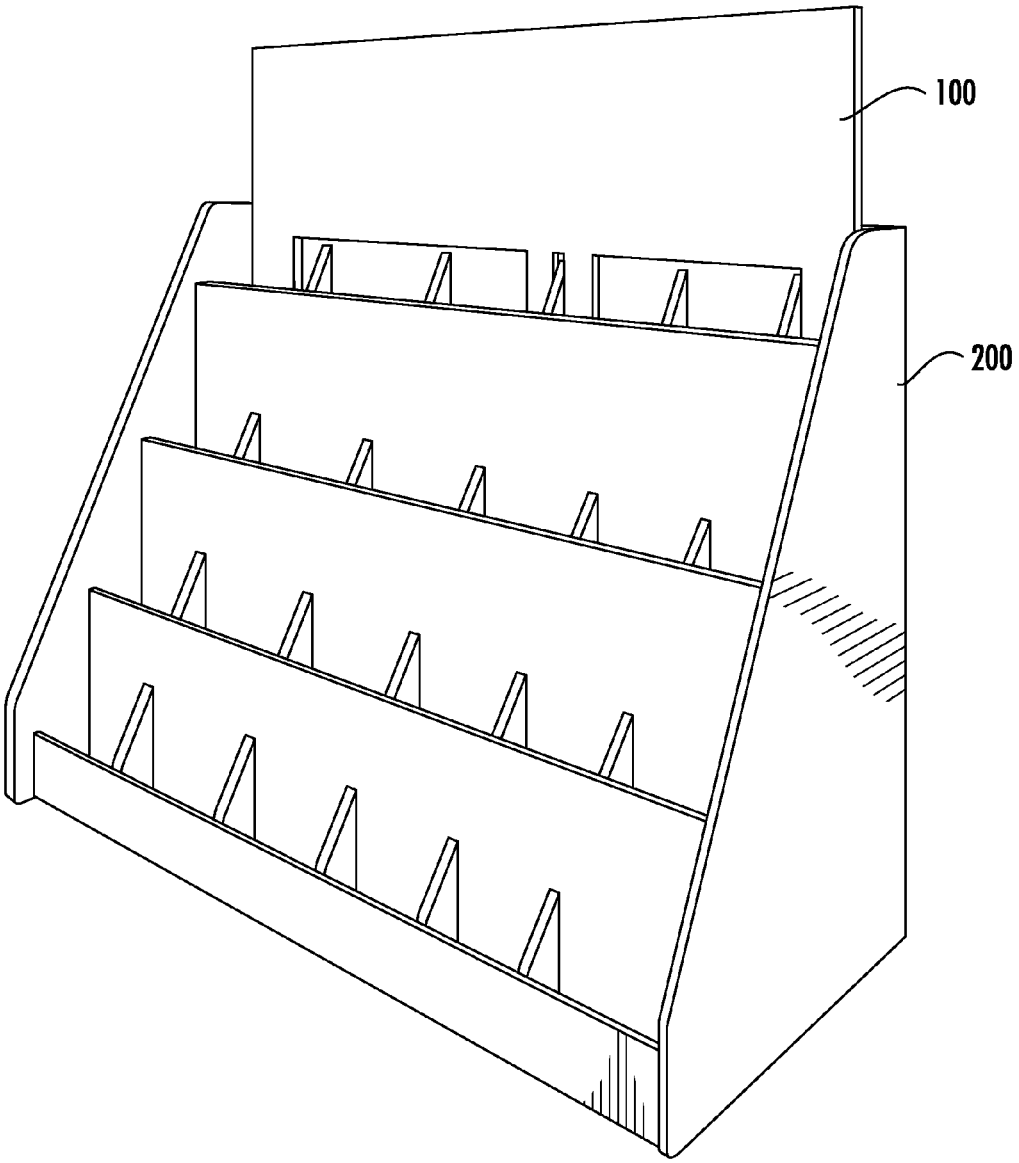
FIG. 1A is a front perspective view of an example display rack and display fixture.

Certain terminology is used in the following description for convenience only and is not limiting. The words "right," "left," "lower," and "upper" designate direction in the drawings to which reference is made. The words "inner" and "outer" refer to directions toward and away from, respectively, the geometric center of the described feature or device. The words "distal" and "proximal" refer to directions taken in context of the item described and, with regard to the instruments herein described, are based on the perspective of the surgeon using such instruments. The terminology includes the above-listed words, derivatives thereof, and words of similar import.

In addition, various components may be described herein as extending horizontally along a longitudinal direction "L" and lateral direction "A," and vertically along a transverse direction "T." Unless otherwise specified herein, the terms "lateral," "longitudinal," and "transverse" are used to describe the orthogonal directional components of various items. It should be appreciated that while the longitudinal and lateral directions are illustrated as extending along a horizontal plane, and that the transverse direction is illustrated as extending along a vertical plane, the planes that encompass the various directions may differ during use. Accordingly, the directional terms "vertical" and "horizontal" are used to describe the components merely for the purposes of clarity and illustration and are not meant to be limiting.

Certain examples of the disclosure will now be described with reference to the drawings. In general, such embodiments relate to a display rack 200 for displaying merchandise and a display fixture 100 used to convey information to a consumer. The display fixture 100 can be coupled to the display rack 200 by inserting portions of the fixture 100 into the product storage spaces 220 of the display rack 200.

Figure 1B:
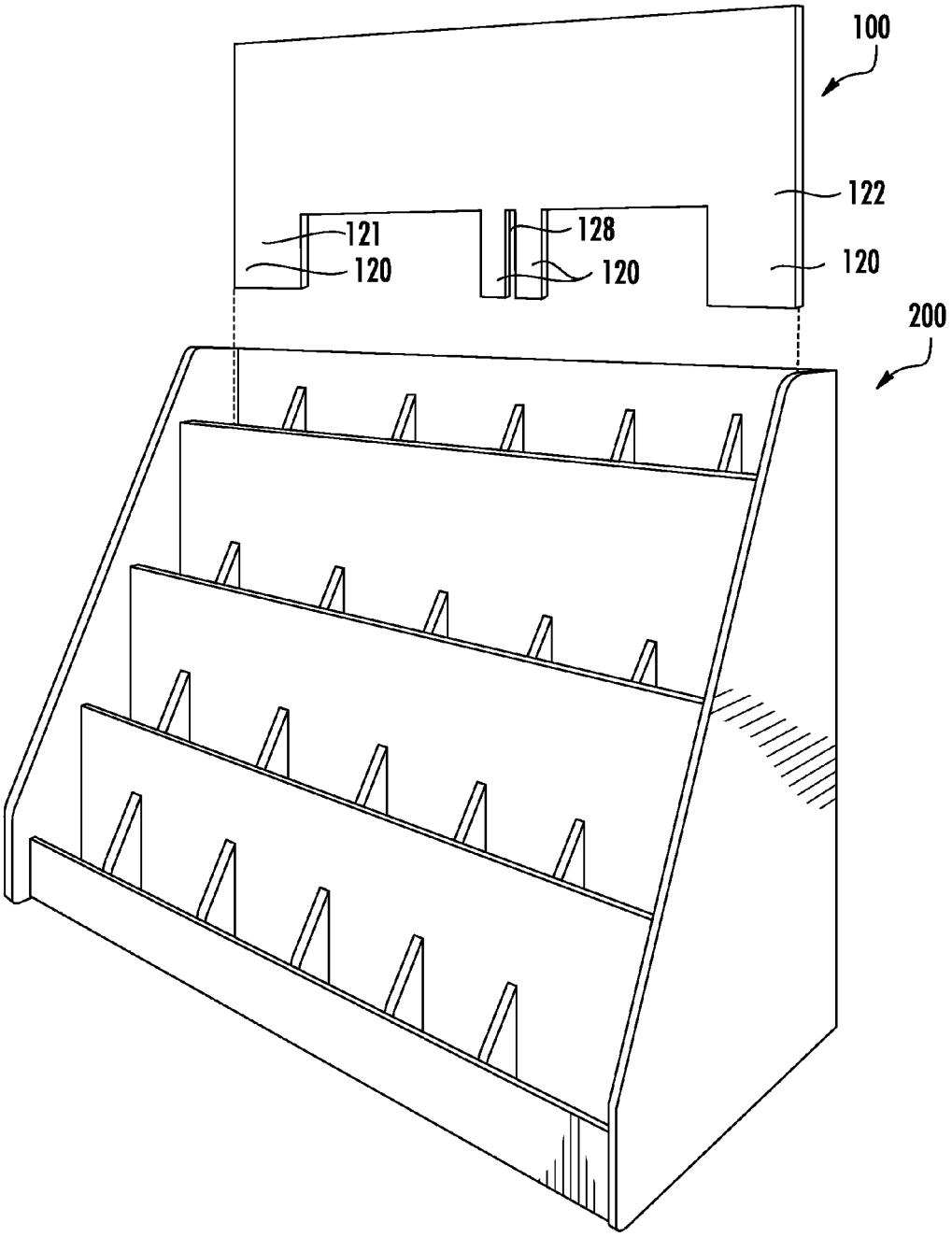
FIG. 1B is an exploded perspective view of an example display rack and display fixture.
Figure 1C:
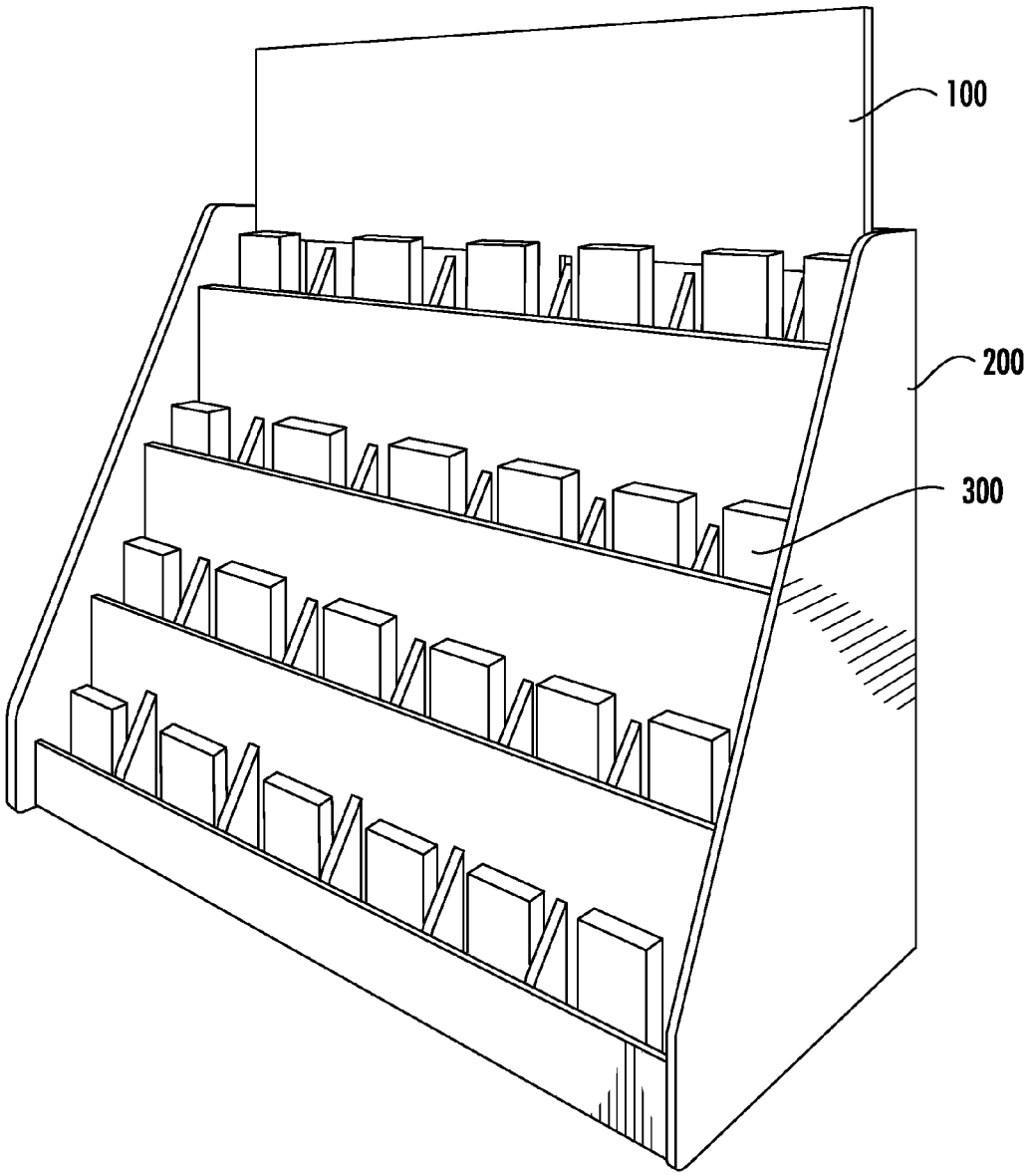
FIG. 1C is a front perspective view of an example display rack and display fixture.

FIG. 1A provides a front perspective view of an example display fixture 100 coupled to a display rack 200. FIG. 1B provides an exploded view of the display fixture 100 and display rack 200 of FIG. 1A. As will be described in more detail below, the display fixture 100 can be coupled to the display rack 200 by inserting portions of the display fixture 100 (e.g., arms/appendages) into the product storage spaces 220 of the display rack 200. As illustrated in FIG. 1C, the display fixture 100 can be coupled to the display rack 200 such that the coupling arms/appendages of the display rack 200 are not visible behind product packages 300 stored in the display rack 200.

As illustrated in FIG. 1C, an example display rack 200 can be used for the storage and display of product packages 300. The product packages 300 can contain clothing products including, for example, undergarments, compression garments, shapewear, hosiery, tights, socks, camisoles, undershirts, tanks, and active wear. While the display rack 200 is described in the context of use with clothing products, those of ordinary skill in the art will recognize that the display rack 200 can be used in a like-manner for other types of products/packages. Similarly, the product packages 300 can be provided in a variety of shapes and sizes configured to be stored in/on a display rack 200.

The display rack 200 can include a plurality of product storage spaces 220. The display rack 200 can include any variety of sized/shaped product storage spaces 220. The product storage spaces 220 can be sized and configured to store and display a corresponding product package 300 and/or packages 300. For example, the width, depth, and/or height of a product storage space 220 can be determined based on the width, depth, and/or height of a corresponding product package 300. The size of the product storage space 220 can be determined to permit both visual and physical access to the product package 300. For example, a portion, majority and/or all of the product package 300 can be visible when stored within the display rack 200. As illustrated in FIG. 1C, the display rack 200 can be used to display/store the product packages 300 in a front-facing (face out) manner. In another example (not shown), the display rack 200 can be used to display/store the product packages 300 in a side-facing (side out) manner. The size and shape of the storage space 220 can also be configured such that the product package 300 is securely retained within the storage space 220 but can also be easily removed. For example, a clearance or gap can be provided between a side edge of the product package 300 and a surface of the product storage space 220. It is contemplated that the number and size/shape of product storage spaces 220 can vary throughout the display rack 200. It is further contemplated that a product storage spaces 220 can be sized and configured to display/store a single and/or multiple product packages 300 in a particular product storage space 220.

The product storage spaces 220 can be separated by a divider 240. The divider 240 can extend between front and rear walls of the product storage space 220. The divider 240 can be used to define the size and shape of the product storage space 220. The distance between adjacent dividers 240 can be determined based on the width of a corresponding product package(s) 300 for display/storage on the display rack 200. Likewise, the depth of a product storage space 220 can be determined based on the depth of a corresponding product package(s) 300 for display/storage in the display rack 200.

As illustrated in FIG. 1C, the product storage spaces 220 can be arranged in the display rack 200 in a horizontal row. The display rack 200 can include multiple rows arranged vertically along a height of the display rack 200. An example display rack 200 can include multiple tiered rows of product storage spaces 220. The tiered rows can be arranged such that the product storage spaces 220 of a particular row overlap a vertical length of the product storage space 220 of the next vertically-adjacent row. For example, in the example display rack 200 illustrated in FIGS. 1A-1C, the display rack 200 can include seven horizontal tiered rows of product storage spaces 220, where each row includes six product storage spaces 220. Because the rows are tiered, the product storage spaces 220 of a lower row overlap the product storage spaces 220 of the next vertically-adjacent row. Accordingly, only a portion of the front surface of the product packages 300 are displayed to the consumer. In another example (not shown), the horizontal rows of product storage spaces 220 can be arranged such that the entire front surface and/or a majority of the front surface of the product packages 300 are visible. It is contemplated that the number and spacing of the rows of product storage spaces 220 can vary both horizontally and vertically with respect to the display rack 200.

As outlined above, a display fixture 100 can be used in conjunction with the display rack 200 to convey information to a consumer. As will be described in further detail below, the display fixture 100 can be coupled to a display rack 200 by inserting portions of the display fixture 100 (e.g., arms/appendages) into the display rack 200. For example, arms 120 of the display fixture 100 can be inserted into the product storage spaces 220 of the display rack 200

As illustrated in FIGS. 1-5, the display fixture 100 can include a display panel 110 defining a display surface for providing information. For example, the information can include product identification and/or marketing information associated with the product packages 300 stored/displayed in the display rack 200. It is contemplated that the information can be permanently and/or temporarily associated with the display panel 110. For example, the information can be provided on a medium that is affixed to the display panel 110 and/or the information can be printed directly onto the display panel 110. The display panel 110 can define any suitable shape for displaying information. For example, the display panel 110 can define a rectangular, square, curved, or any other regular or irregular shape. The display panel 110 can include lighting fixtures/elements, electronic signage/features (e.g., active or passive electronic graphic user interface), and/or audio elements (e.g., speakers).

The display fixture 100 can include a number of arms 120 extending from the bottom edge 112 of the display panel 110. As illustrated in FIGS. 2-5, the arms can define a rectangular shaped protrusion extending from the bottom edge 112 of the display panel 110. It is contemplated, however, that the arms 120 can define a rectangular, square, curved, or any other regular or irregular shape. The arms 120 can be integral to the display panel 110. In another example (not shown), the arms 120 can be coupled to the display panel 110. For example, arms 120 can be coupled to the display panel 110 using mechanical and/or chemical fasteners including bolts, rivets, screws, staples, press fit, welds, adhesives, and/or any other form of mechanical/chemical connection known in the art. As provided in FIGS. 2-5, the display panel 110 and the arms 120 can be coplanar. In another example (not shown), the display panel 110 and the arms 120 are not coplanar, that is, at least one of the arms 120 can be offset from a surface of the display panel 110. The arms 120 can be spaced apart along the bottom edge of the display fixture 100. It is contemplated that the number and spacing the arms 120 can vary. The arms 120 can extend along the side edges of the display panel 110. For example, the display fixture 100 can include a continuous left edge 140 extending between the display panel 110 and a first arm 121. Opposite the left edge 140, the display fixture 100 can include a continuous right edge 150 extending between the display panel 110 and a second arm 122.

The arms 120 can be used to couple the display fixture 100 to the display rack 200. For example, the arms 120 can be sized and configured for insertion into the product storage spaces 220 of the display rack 200. That is, the arms 120 can have a size and shape corresponding to the interior size and shape of the product storage spaces 220. In operation, the display fixture 100 is provided to the display rack 200 and arms 120 are aligned with corresponding product storage spaces 220. As illustrated in FIG. 1A, the arms 120 can be inserted into the product storage spaces 220 such that the display fixture 100 is securely coupled to the display rack 200. If arm 120 includes as recess 128, as will be described in more detail below, the recess 128 can be provided over a divider 240 separating adjacent product storage spaces 220 of the display rack 200. As provided in FIG. 1C, product packages 300 can then be added to the product storage spaces 220 in front of or behind the arms 120. It is also contemplated that the arms 120 of the display fixture 100 can be provided to product storage spaces 220 already including product packages 300. As illustrated in FIGS. 1A and 1C, the display fixture 100 can be positioned along a horizontal row of the product storage spaces 220. For example, the arms 120 (e.g., 122, 123, 124, etc.) of the display fixture 100 can be coupled to and/or along the top row of product storage spaces 220 (e.g., 222, 223, 224, 225, 226, etc.) included on the display rack 200. The first arm 121 can be received within a first product storage space 221 and the second arm 122 can be received within a second product storage space 222. The display fixture 100 can be easily withdrawn from the display rack 200/product storage spaces 220 by moving the display fixture 100 in the direction opposite insertion.

The arms 120 can be sized to permit the display fixture 100 to be removably coupled to the display rack 200 product storage spaces 220. For example the arms 120 can be sized such that they are securely retained within the storage space 220 but can also be removed without the need of excessive force of the use of tools. For example, a clearance or gap can be provided between a side edge of the storage space 220 and a side surface of the arm 120. In one example, the size of the arms 120 can be such that a gap of 1 cm is provided between the side edge of the arm 120 and the surface of the product storage space 220. In another example, the size of the arms 120 can be such that a gap of less than 1 cm is provided between the side edge of the arm 120 and the surface of the product storage space 220. In a further example, the size of the arms 120 can be provided so there is no gap between the side edge of the arm 120 and the surface of the product storage space 220 and a press fit/interference fit between the arm 120 and the product storage space 220 is created.

While the display fixture 100 is described as removably coupled to the display rack 200, it is contemplated that the display fixture 100 and can be permanently and/or fixedly coupled to the display rack 200. For example, a permanent and/or releasable fastener may be provided to secure the arms 120 to the display rack 200 and/or product storage spaces 220. For example, the arms 120 can be coupled/fastened to the display rack 200 using mechanical and/or chemical fasteners including bolts, rivets, screws, staples, press fit, welds, adhesives, and/or any other form of mechanical/chemical connection known in the art.

The arms 120 can extend from the bottom edge of the display panel 110 a predetermined length (l). The length (l) of the arms 120 measured from the bottom edge 112 of the display panel 110 to a bottom edge 126 of the arms 120. The arms 120 can have a length that corresponds to the depth of the product storage space 220. For example, the length of the arms 120 can be such that the bottom edge 128 of the arm 120 rests on or otherwise contacts the bottom inside surface of the storage space 220. Likewise the width (w) of the arms 120 measured between opposite left and right sides of the arm 120 can correspond to the width of the product storage space (with or without a gap as described above). In another one example, the size of the arms 120 can be such that they correspond to the size of a product package 300 stored in the display rack 200 storage space 220. For example, the length of the arms 120 can correspond to the length of the product package 300 and the width (w) of the arms 120 can correspond to the width of the product package 300.

In an example display fixture 100, the length (l) of the arms 120 can be between 15 cm to 25 cm. In another example, the length (l) of the arms 120 can be between 20 cm and 25 cm. In a further example, the length (l) of the arms 120 can be between 20 cm and 22 cm. In yet another example, the length (l) of the arms 120 can be between 22 cm and 23 cm. In an example display fixture 100, the width (w) of the arms 120 can be between 15 cm to 25 cm. In another example, the width (w) of the arms 120 can be between 15 cm and 20 cm. In a further example, the width (w) of the arms 120 can be between 17 cm and 20 cm. In yet another example, the width (w) of the arms 120 can be between 17 cm and 19 cm. In a further example, the width (w) of the arms 120 can be between 17 cm and 18 cm. In another example, the width (w) of the arms 120 can be between 18 cm and 19 cm.

It is contemplated that the size and shape of various arms 120 can be consistent and/or vary along the display fixture 100. For example, the length, width and/or shape of each of the arms 120 can match (see e.g., FIGS. 3-5). In another example display fixture 100, the length, width and/or shape of each of the arms 120 can vary (see e.g., FIGS. 1B and 2).

In an example display fixture 100, one or more of the arms 120 can include a recess 128. The recess 128 can define an opening that extends from the bottom edge 126 of the arm 128 in a direction towards the bottom edge 112 of the display panel 110. The recess 128 can be sized and configured for placement over a divider 240 included on the display rack 200 separating adjacent product storage spaces 220. Accordingly, a portion of the arm 120 extends into each of the adjacent storage spaces 220. The recess 128 can be sized and configured to be securely and removably placed over the divider 240. The width (w) of the recess 128, therefore, can correspond to the width of the divider 128. For example, a clearance or gap can be provided between a side edge of the recess 128 and a side edge of the divider 240. In one example, the width (w) of the recess 128 can be such that a gap of 1 cm is provided between both of the side edges of the recess 128 and the side surfaces of the divider 240. In another example, the width (w) of the recess 128 can be such that a gap of less than 1 cm is provided between both of the side edges of the recess 128 and the side surfaces of the divider 240. In a further example, the width (w) of the recess 128 can be provided so there is no gap between the side edge of the recess 128 and the surface of the divider 240 and a press fit/interference fit between the recess 128/arm 120 and the divider 240 is created. In another example, the recess 128 can be sized and shaped such that a portion of the recess 128 contacts the surface of the divider 240. For example, the recess 128 can include a projection extending from one or more of the side edges of the recess 128 for contacting the surface of the divider 240 and providing a press fit/interference fit between the projection and the divider 240. In an example display fixture 100, the width (w) of the recess 128 can be between 0.5 cm and 5 cm. In another example, the width (w) of the recess 128 can be between 0.5 cm and 4 cm. In a further example, the width (w) of the recess 128 can be between 0.5 cm and 3 cm. In yet another example, the width (w) of the recess 128 can be between 0.5 cm and 2 cm. In a further example, the width (w) of the recess 128 can be between 0.5 cm and 1 cm.

As outlined above, the recess 128 can define an opening that extends from the bottom edge 126 of the arm 120 in a direction towards the bottom edge 112 of the display panel 110. The recess 128 can extend from bottom edge 126 a predetermined length (l). In one example, the length (l) of the recess 128 can correspond to the length of the arm 120, that is, the length (l) of the recess 128 can extend to the bottom edge 112 of the display panel 110. The length (l) of the recess 128 can also extend beyond the bottom edge 112 of the display panel 110. In another example, the length (l) of the recess 128 can extend towards, but not completely to, the bottom edge 112 of the display panel 110. The length (l) of the recess 128 can also correspond to the height/length of the divider 240. In one example, the length (l) of the recess 128 can be between 15 cm to 25 cm. In another example, the length (l) of the recess 128 can be between 20 cm and 25 cm. In a further example, the length (l) of the recess 128 can be between 20 cm and 22 cm. In yet another example, the length (l) of the recess 128 can be between 22 cm and 23 cm.

The display fixture 100 can also have a thickness (t) such that the arms 120 of the display fixture 100 are securely and removably retained within the product storage space 220. As illustrated in FIGS. 2-5, the display fixture 100 can have a uniform thickness (t) between the display panel 110 and the arms 120. In another example (not shown), the thickness between the arms 120 and the display panel 110 can vary. The thickness (t) of the display fixture 100 can be determined such that the arms 120 of the display fixture 100 are securely and removable retained within a product storage space 220 with and without a product package(s) 300. For example, the thickness (t) of the arms 120 of the display fixture 100 can be determined such that the arms 120 are retained within the product storage space 220 in addition to at least one, if not a plurality of, product package(s) 300. An example display fixture 100 can have a thickness (t) between 0.2 cm and 1.5 cm. In another example, the display fixture 100 can have a thickness (t) between 0.2 cm and 1 cm. In a further example, the display fixture 100 can have a thickness (t) between 0.2 cm and 0.8 cm. In yet another example, the display fixture 100 can have a thickness (t) between 0.2 cm and 0.5 cm.

The display fixture 100 can be constructed from a light weight yet sturdy material. For example, the display fixture 100 can be constructed from a polymeric material, a cellulose-based material, or a combination thereof. The display fixture 100 can be constructed from a material that has a basis weight/weight per area/area density between 0.5 kg/m$^2$ to 2.5 kg/m$^2$. In another example, the display fixture 100 can have a basis weight/area density between 1 kg/m$^2$ to 2 kg/m$^2$.

Example polymeric materials include a styrene-butadiene copolymer (e.g., acrylonitrile-butadiene-styrene (ABS), an acrylic copolymer, polyvinyl chloride (e.g., expanded PVC), polypropylene (e.g., single or twinwall fluted polypropylene boards), polystyrene (e.g., extruded polystyrene bonded, high impact polystyrene (HIPS) such as ULTRA BOARD manufactured by United Industries), polyethylene terephthalate (PET), glycol-modified polyethylene terephthalate (PET-G), polycarbonate, polyethylene, polyurethane (e.g., high density urethane (HDU) board), or a combination thereof.

Example cellulose-based materials can include paper, paperboard, textiles, or a combination thereof. The cellulose-based material can have a basis weight between 60 g/m$^2$ and 225 g/m$^2$.

As outlined above, the display fixture 100 can be constructed from a polymeric material, a cellulose-based material, or a combination thereof. For example, the display fixture 100 can include a polymeric material layer and a cellulose-based material layer. The cellulose-based material layer and the polymeric material layer can be bonded together. For example, the cellulose-based material layer and the polymeric material layer can be bonded together by lamination, an adhesive, heat bonding, mechanical coupling, and/or any other mechanical and/or chemical coupling known in the art for bonding a polymeric material layer to a cellulose-based material layer. An example material would include an extruded polystyrene bonded to/between a paper layer (e.g., foam board).

FIGS. 2A-2D provide an example display fixture 100 including a first arm 121, a second arm 122 and a third arm 123 extending from a bottom edge 112 of the display panel 110. The third arm 123 extends from the bottom edge 112 at a position between the first and second arms 121, 122. The first arm 121, second arm 122 and third arm 123 can be sized and configured for placement in a product storage space 220 of the display rack 200. For example, the first arm 121 can be sized and located for placement in a first product storage space 221 and the second arm 122 can be sized and located for placement in a second product storage space 222.

The third arm 123, intermediate the first and second arms 121, 122, can include a recess 128. The recess 128 can define an opening extending from the bottom edge 128 of the third arm 123 in a direction towards the bottom edge 112 of the display panel 110. The recess 128 can be sized and located for placement over the divider 240 separating a third and fourth product storage space 223, 224. Accordingly, a portion of the third arm 123 extends into the third product storage space 223 and another portion of the third arm 123 extends into the fourth product storage space 224.

Figure 2D:
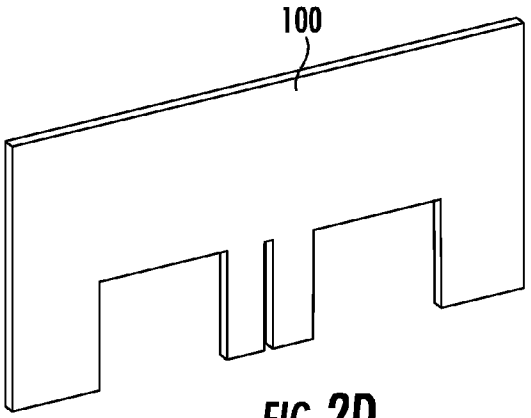
FIG. 2D is a perspective view of an example display fixture.
Figure 2C:
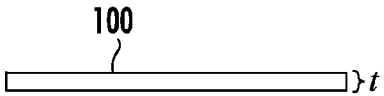
FIG. 2C is a side view of an example display fixture.
Figure 2A:
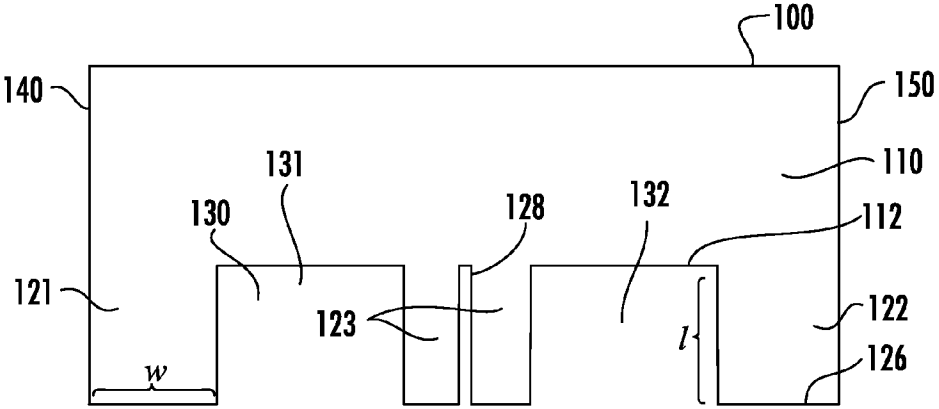
FIG. 2A is a front view of an example display fixture.
Figure 2A:
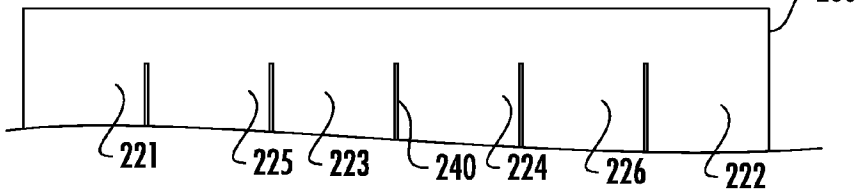
Figure 2B:
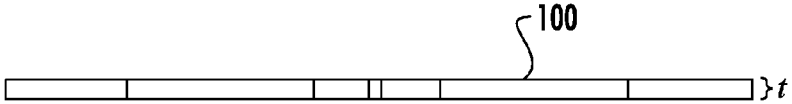
FIG. 2B is a top view of an example display fixture.
Figure 3D:
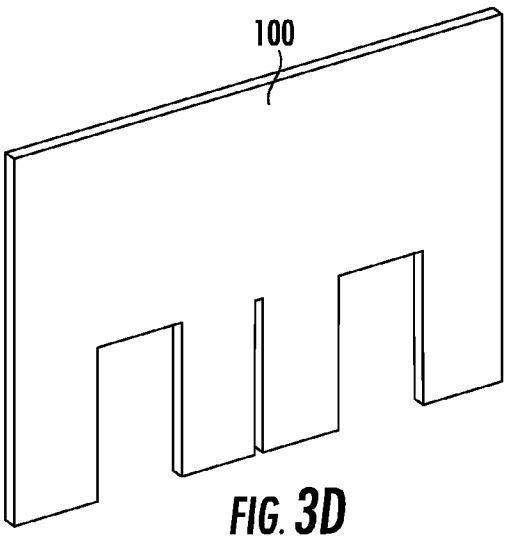
FIG. 3D is a perspective view of an example display fixture.
Figure 3C:
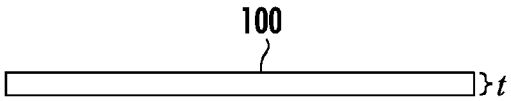
FIG. 3C is a side view of an example display fixture.
Figure 3A:
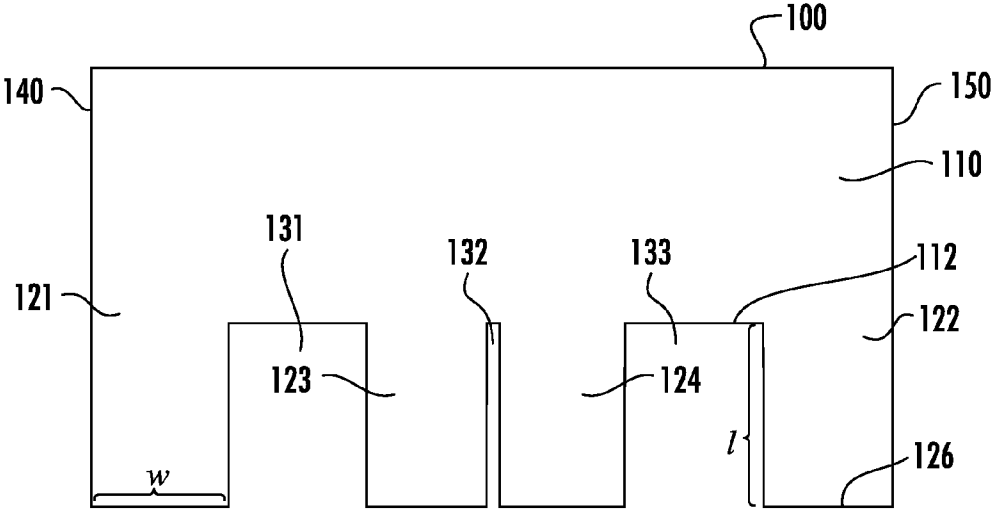
FIG. 3A is a front view of an example display fixture.
Figure 3A:
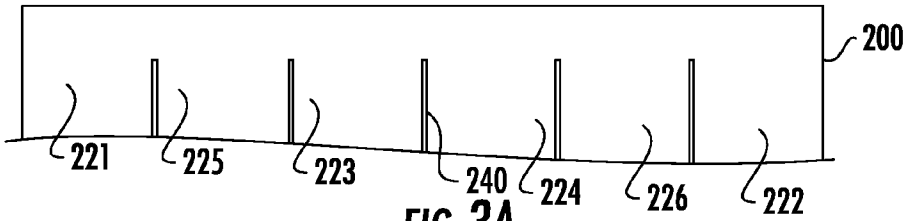
Figure 3B:
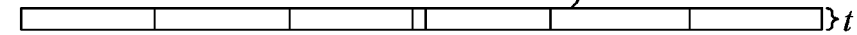
FIG. 3B is a top view of an example display fixture.

As illustrated in FIGS. 2A-2D, the first arm 121, second arm 122 and third arm 123 can be similarly sized and shaped. For example, the first arm 121, second arm 122 and third arm 123 can have the same width (w) and length (l). The display fixture 100 can also include a gap 130 extending between adjacent arms 120. For example, the display fixture 100 can include a first gap 131 extending along the bottom edge 112 of the display panel 110 between the first arm 121 and the third arm 123 and a second gap 132 extending along the bottom edge 112 of the display panel 110 between the third arm 123 and the second arm 122. Each of the first gap 131 and the second gap 132 can be sized and configured to extend over at least one product storage space 220. As illustrated in FIG. 2A, the first gap 131 and the second gap 132 can have the same width. Though not illustrated in this example, it is contemplated, however, that the size and shape of the first, second and third arms 121, 122, 123 and the size and shape of the first gap 131 and the second gap 132 can vary along the display fixture 100.

The display fixture 100 of FIGS. 2A-2D is depicted for use with a display rack 200 including at row of at least six product storage spaces 220 (221, 222, 223, 224, 225, 226). The first and second arms 121, 122 are sized for placement in first and second product storage spaces 221, 222, respectively. The recess 128 included in the third arm 123 is configured for placement over the divider separating a third and fourth product storage space 223, 224. The first gap 131 extends over the fifth product storage space 225 and a portion of the third product storage space 223. The second gap 132 extends over the sixth product storage space 226 and a portion of the fourth product storage space 224.

FIGS. 3A-3D provide another example display fixture 100. The display fixture 100 can include a first arm 121, a second arm 122, a third arm 123 and a fourth arm 124 extending from the bottom edge of the display panel 110. The first arm 121, second arm 122, third arm 123 and fourth arm 124 can be sized and configured for placement in a product storage space 220 of the display rack 200. For example, the first arm 121 can be sized and located for placement in a first product storage space 221, the second arm 122 can be sized and located for placement in a second product storage space 222, the third arm 123 can be sized and located for placement in a third product storage space 223 and the fourth arm 124 can be sized and located for placement in a fourth product storage space 224.

The display fixture 100 can include a first gap 131 extending between the first arm 121 and the third arm 123 and a second gap 132 extending between the third arm 123 and the fourth arm 124 and a third gap 133 extending between the fourth arm 124 and the second arm 122. The first gap 131 and the third gap 133 can be sized and configured to extend over at least one product storage space. The second gap 132 can be sized to extend over a divider separating the third and fourth product storage space 223, 224.

As illustrated in FIGS. 3A-3D, the first arm 121, second arm 122, third arm 123 and fourth arm 124 can be similarly sized and shape. Likewise, the first gap 131 and the third gap 133 can be similarly sized and shaped. As provided in FIGS. 3A-3D, the width of the first arm 121, second arm 122, third arm 123 and fourth arm 124 and the first gap 131 and third gap 133 can correspond to each other and/or the width of their associated product storage spaces. For example, the first arm 121, second arm 122, third arm 123 and fourth arm 124 can have the same width (w) and length (l). Similarly, the first gap 131 and the third gap 133 can have the same width. Though not illustrated, it is contemplated that the size and shape of the first, second, third, and fourth arms 121, 122, 123, 124 and the size and shape of the first, second, and third gap 131, 132, 133 can vary along the display fixture 100.

The display fixture 100 of FIGS. 3A-3D is depicted for use with a display rack 200 including at row of at least six product storage spaces 220. The first and second arms 121, 122 are sized for placement in a first and second product storage spaces 221, 222, respectively. Likewise, the third and fourth arms 123, 124 are sized for placement in the third and fourth product storage spaces 223, 224, respectively. The first gap 131 extends over the fifth product storage space 225, the third gap 133 extends over the sixth product storage space 226, and the second gap 132 extends over the divider 240 separating the third and fourth product storage spaces 223, 224.

FIGS. 4A-4D provide another example display fixture 100. The display fixture 100 can include a first arm 121 and a second arm 122 extending from the bottom edge of the display panel 110. The first arm 121 and the second arm 122 can be sized and configured for placement in a product storage space 220 of a display rack 200. For example, the first arm 121 can be sized and located for placement in a first product storage space 221 and the second arm 122 can be sized and located for placement in a second product storage space 222.

As provided in FIGS. 4A-4D, the first arm 121 and the second arm 122 can be similarly sized and shape. For example, the width of the first arm 121 can correspond to the width of the second arm 122 and/or the width of their associated product storage spaces 220. In one example, the first arm 121 and the second arm 122 can have the same width (w) and length (l). Though not illustrated, it is contemplated, that the size and shape of the first and second arms 121, 122 can vary along the display fixture 100.

Figure 4D:
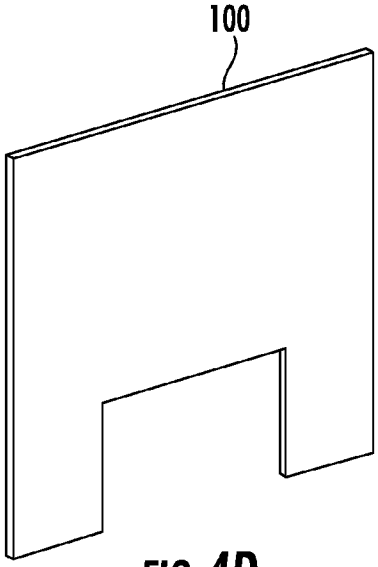
FIG. 4D is a perspective view of an example display fixture.
Figure 4C:
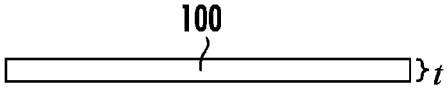
FIG. 4C is a side view of an example display fixture.
Figure 4A:
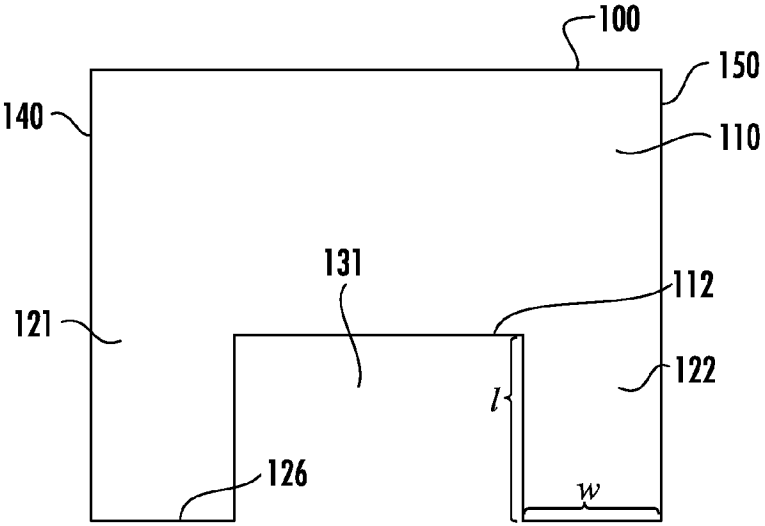
FIG. 4A is a front view of an example display fixture.
Figure 4A:
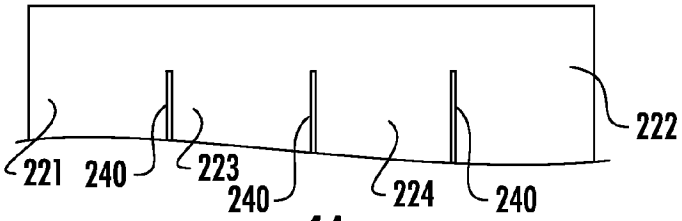
Figure 4B:
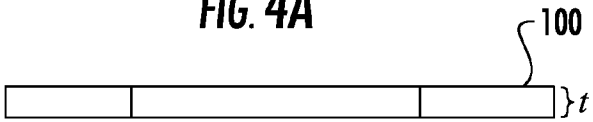
FIG. 4B is a top view of an example display fixture.
Figure 5D:
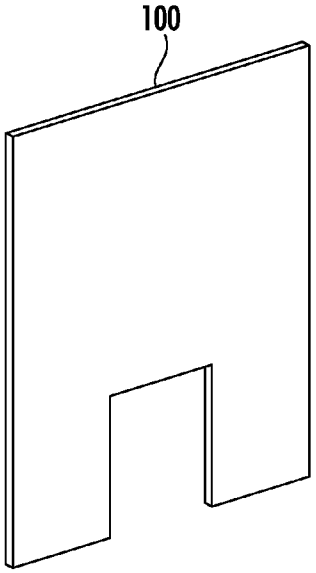
FIG. 5D is a perspective view of an example display fixture.
Figure 5C:
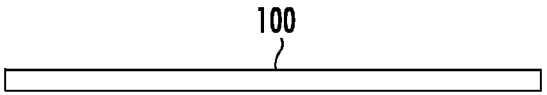
FIG. 5C is a side view of an example display fixture.
Figure 5A:
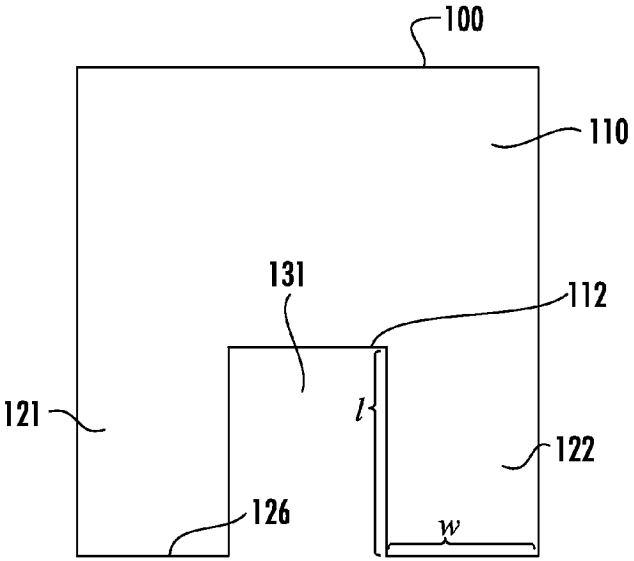
FIG. 5A is a front view of an example display fixture.
Figure 5A:
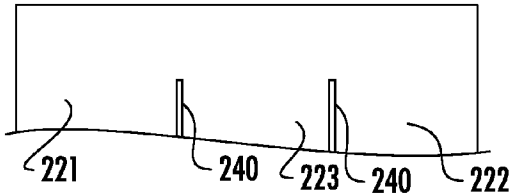
Figure 5B:
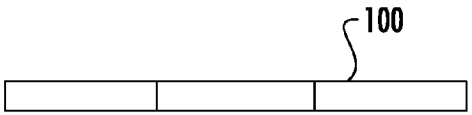
FIG. 5B is a top view of an example display fixture.

The display fixture 100 of FIGS. 4A-4D is depicted for use with a display rack 200 including at row of at least four product storage spaces 220. The first and second arms 121, 122 are sized for placement in a first and second product storage spaces 221, 222, respectively. The display fixture 100 can include a first gap 131 extending between the first arm 121 and the second arm 122. The first gap 131 can be sized and configured to extend over at least one product storage space. As illustrated in FIG. 4A, the first gap 131 can extend over the third and fourth product storage spaces 223, 224.

FIGS. 5A-5D provide another example display fixture 100. The display fixture 100 can include a first arm 121 and a second arm 122 extending from the bottom edge 112 of the display panel 110. The first arm 121 and the second arm 122 can be sized and configured for placement in a product storage space 220 of a display rack 200. For example, the first arm 121 can be sized and located for placement in a first product storage space 221 and the second arm 122 can be sized and located for placement in a second product storage space 222.

As provided in FIGS. 5A-5D, the first arm 121 and the second arm 122 can be similarly sized and shape. For example, the width of the first arm 121 can correspond to the width of the second arm 122 and/or the width of their associated product storage spaces. In one example, the first arm 121, second arm 122 and third arm 123 can have the same width (w) and length (l). Though not illustrated, it is contemplated, that the size and shape of the first and second arms 121, 122 can vary along the display fixture 100.

The display fixture 100 of FIGS. 5A-5D is depicted for use with a display rack 200 including at row of at least three product storage spaces 220. The first and second arms 121, 122 are sized for placement in a first and second product storage spaces 221, 222, respectively. The display fixture 100 can include a first gap 131 extending between the first arm 121 and the second arm 122. The first gap 131 can be sized and configured to extend over at least one product storage space 220. As illustrated in FIG. 4A, the first gap 131 can extend over the third product storage space 223.

The display fixtures 100 illustrated in FIGS. 2-5 are provided for example only. It is contemplated that that a display fixture 100 can include any number of arms 120, recesses 128 and gaps 130. The number, size, shape and spacing of the arms 120, recesses 128 and gaps 130 can be determined based on the number, size, shape and spacing of the corresponding product storage spaces and dividers included on the display rack 200.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a display panel defining a display surface for providing information to a consumer;

a first arm extending from a bottom edge of the display panel configured for placement in a product storage space of an associated display rack;

a second arm extending from the bottom edge of the display panel configured for placement in a product storage space of an associated display rack;

a third arm extending from the bottom edge of the display panel at a position between the first arm and the second arm, the third arm including a recess having a recess width corresponding to a width of a divider separating adjacent product storage spaces of an associated display rack;

wherein at least one of the first arm, second arm, and third arm have a width corresponding to a width of a product storage space of an associated display rack.

2. The display fixture of claim 1, wherein the display panel, first arm, second arm and third arm are coplanar.

3. The display fixture of claim 1, further comprising:

a first continuous edge extending between the display panel and the first arm, and a second continuous edge extending between the display panel and the second arm.

4. The display fixture of claim 1, wherein the width of at least one of first arm, second arm, and the third arm is between 15 cm and 25 cm.

5. The display fixture of claim 1, wherein the recess extends from a bottom edge of the third arm in a direction towards the display panel.

6. The display fixture of claim 1, where in the recess width of the third arm is between 0.5 cm and 5 cm.

7. The display fixture of claim 1, wherein the at least one of the first arm, second arm and third arm have a length measured from the bottom edge of the display panel and a bottom edge of the corresponding arm such that the length corresponds to a depth of a product storage space of an associated display rack;

wherein the length is between 15 cm and 25 cm.

8. The display fixture of claim 1, wherein the display fixture has a thickness between the display surface and a back surface of between 0.2 cm and 1 cm.

9. The display fixture of claim 1, wherein the display fixture has a basis weight between 0.5 kg/m$^2$ and 2.5 kg/m$^2$.

10. The display fixture of claim 1, wherein the display fixture comprising a polymeric material, a cellulose-based material, or a combination thereof.

11. The display fixture of claim 10, wherein the polymeric material includes a styrene-butadiene copolymer, an acrylic copolymer, polyvinyl chloride, polypropylene, polystyrene, polyethylene terephthalate (PET), glycol-modified polyethylene terephthalate (PET-G), polycarbonate, polyethylene, polyurethane, or a combination thereof.

12. The display fixture of claim 10, wherein the cellulose-based material comprises paper, paperboard, or a combination thereof.

13. The display fixture of claim 12, wherein the cellulose-based material has a basis weight between 60 g/m$^2$ and 225 g/m$^2$.

14. The display fixture of claim 10, wherein the display fixture comprises a cellulose-based material layer and a polymeric material layer, wherein the cellulose-based material layer and the polymeric material layer are bonded together.

15. The display fixture of claim 14, wherein the cellulose-based material layer and the polymeric material layer are bonded together by lamination, an adhesive, heat bonding, or mechanical coupling.

16. The display fixture of claim 15, wherein the polymeric material layer comprises an extruded polystyrene.

17. A product display rack and associated display fixture comprising:

the display rack including product storage spaces configured to display a product package in a front-facing manner, the product storage spaces arranged in rows vertically along a height of the display rack;

the display fixture including:

a display panel defining a display surface for providing information to a consumer;

a first arm extending from a bottom edge of the display panel configured for placement in a first product storage space of the display rack;

a second arm extending from the bottom edge of the display panel configured for placement in a second product storage space of the display rack;

a third arm extending from the bottom edge of the display panel at a position between the first arm and the second arm, the third arm including a recess having a recess width corresponding to a width of a divider separating adjacent product storage spaces of the display rack;

wherein at least one of the first arm, second arm, and third arm have a width corresponding to a width of at least one of the product storage spaces of the display rack, wherein the display fixture is positioned along a row of product storage spaces such that the first arm is received within a first product storage space and the second arm is received in a second product storage space.

18. The product display rack and associated display fixture of claim 17, wherein the display fixture is positioned along a top row of the display rack.

19. The product display rack and associated display fixture of claim 17, wherein the first arm is separated from the third arm by a first gap extending along the bottom edge of the display panel, and the third arm is separated from the second arm by a second gap extending along the bottom edge of the display panel, wherein at least one of the first gap and the second gap extend over at least one product storage space.

20. The product display rack and associated display fixture of claim 17, wherein the rows of the display rack are tiered, wherein the tiered rows are arranged such that the product storage spaces of adjacent rows overlap a vertical length of the product storage space of the vertically-adjacent row.

21. A method of providing a display fixture to a display rack, the method comprising:

providing a display fixture having a display panel, a first arm, a second arm and a third arm each extending from a bottom edge of the display panel, the third arm located at a position between the first and second arm;

receiving the first arm within a first product storage space of the display rack;

receiving the second arm within a second product storage space of the display rack;

receiving a recess provided in the third arm over a divider separating adjacent product storage spaces of the display rack.

* * * * *